United States Patent [19]

Suwa

[11] Patent Number: 4,638,151

[45] Date of Patent: Jan. 20, 1987

[54] KEYBOARD OF AN ELECTRONIC APPARATUS

[75] Inventor: Kaname Suwa, Yokohama, Japan

[73] Assignee: Canon Kabushiki Kaisha, Tokyo, Japan

[21] Appl. No.: 735,194

[22] Filed: May 17, 1985

[30] Foreign Application Priority Data

May 25, 1984 [JP] Japan ..... 59-105719
May 25, 1984 [JP] Japan ..... 59-105720
May 25, 1984 [JP] Japan ..... 59-105721

[51] Int. Cl.[4] ..... G06C 7/02

[52] U.S. Cl. ..... 235/145 R; 235/145 A; 200/5 A; 200/159 A; 200/340

[58] Field of Search ..... 235/145 R, 145 A; 200/5 A, 159 A, 340

[56] References Cited

U.S. PATENT DOCUMENTS 3,823,309 7/1974 Caruso ..... 235/145 R
4,311,893 1/1982 Tsuchiya et al. ..... 200/5 A
4,315,114 2/1982 Monti, Jr. ..... 200/5 A

*Primary Examiner*—Benjamin R. Fuller
*Attorney, Agent, or Firm*—Fitzpatrick, Cella, Harper & Scinto

[57] ABSTRACT

A plurality of keytops are held by means of a single leaf spring to prevent erroneous insertion of the keytops into opening portions formed in a frame and to prevent the keytops from being removed from the opening portions. For prevention of unstable movement of the keytops, the leaf spring holding a plurality of keytops is contacts projections formed on the frame to be deformed thereby applying the initial pressure. Further, in order to reduce the number of assembly processes in attaching the leaf spring holding a plurality of keytops to the frame and the number of parts which are attached, each end of the spring portions connected to the plurality of keytops is coupled at a single portion and fixed to the frame.

7 Claims, 4 Drawing Figures

KEYBOARD OF AN ELECTRONIC APPARATUS

BACKGROUND OF THE INVENTION

1. Field of the Invention

The present invention relates to a keyboard in which keytops are attached to the opening portion formed in a frame of an electronic apparatus.

2. Description of the Prior Art

Keyboards for use in input apparatuses of electronic apparatuses are generally constituted such that keytops extend through a plurality of key holes formed in the frame.

Recently, in such electronic apparatus, there is a tendency to add various functions, such as time clock, alarm, etc., and simultaneously realization of a miniaturized and thin apparatus is intended for the purposes of energy saving and ease in handling, etc. Therefore, there is also a tendency such that the number of keytops in the keyboard of such a kind of electronic apparatus increases and its shape is also miniaturized and thinned, so that various problems are caused in assembling processes and efficiency in maintenance and inspection. The conventional structure consequently has a problem such that it takes considerable time and labor for assembling the keyboard.

Practically speaking, a conventional keyboard generally has a structure in which a keytop with a flange is brought into engagement with a key hole from the back surface (lower surface) of a frame (upper casing) and a spring built in the space between the frame and a lower casing (lower frame) contacts the back surface of the keytop, and thereby applying an upward recovery force to the keytop.

Therefore, if the upper and lower casings are separated for adjustment, inspection or the like of electronic parts, each keytop is removed and dispersed from the frame, so that this causes a problem such that not only is a large amount of labor required for reassembly but also the keytops can be easily erroneously inserted. In this case, each keytop has to be inserted from the back side of the frame and it is difficult to check the character or symbol printed on the upper surface of the keytop upon insertion; therefore, a serious problem is caused in case of a keyboard having a number of keytops and a countermeasure for such a problem is in strong demand.

On the other hand, there has been adopted a method whereby a monolithic thin leaf spring is used as a keytop return spring thereby to reduce the number of parts. However, a flat and thin leaf spring cannot be used in the foregoing conventional structure and the bending or reducing process is needed upon manufacturing. Consequently, there are problems such that handling is inconvenient and the number of assembly operations is large.

SUMMARY OF THE INVENTION

It is the first object of the present invention to keep the state in that the frame and keytops in the keyboard section are always assembled in case of separating the upper and lower casings.

It is the second object of the invention to make it possible to assemble a thin and flat leaf spring to the frame in the state in that there is no oscillation in keytops by applying an initial pressure to the keytops and also to enable this thin flat leaf spring to be used as a keytop return spring.

The third object of the invention is to provide a keyboard using a keytop return spring by which the number of processes to assemble the thin leaf spring to the frame and the number of parts are reduced thereby reducing the manufacturing costs.

DETAILED DESCRIPTION OF THE PREFERRED EMBODIMENT

Figure 1:
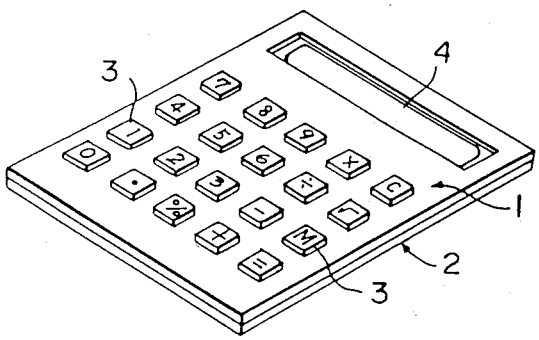
FIG. 1 is a perspective view showing an example of an electronic apparatus which is suitable to embody the present invention.

FIG. 1 shows a small-sized electronic computer (electronic calculator) which is suitable to apply the present invention. Electronic parts such as a circuit substrate and the like are enclosed between an upper casing 1 and a lower casing 2. Input operations are performed by pressing a plurality of keytops 3 arranged on the upper casing 1. The result of calculation or the like is displayed in a display window 4 formed in the upper casing 1.

In the example shown in the diagram, the upper casing 1 also serves as a frame of the keyboard. The keytops 3 are inserted into a plurality of key holes formed in the frame (upper casing) 1, respectively. A character or symbol is printed on the upper surface of each keytop 3. Each keytop 3 is assembled at the position protruding from the surface of the frame 1 and is pressed and operated against a return spring.

The upper and lower casings 1 and 2 and the keytops 3 are molded from a plastic. However, they may be formed by molding other material such as metal or the like case by case.

Figure 2:
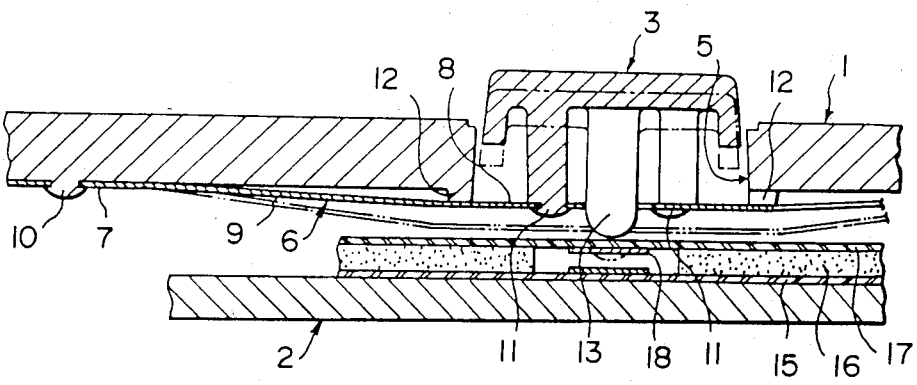
FIG. 2 is a partial vertical sectional view showing a keyboard according to one embodiment of the invention and its using state.

FIG. 2 shows a partial cross section of the keyboard, in which the keytop 3 is inserted into a key hole 5 formed in the frame 1 and each keytop 3 is coupled to the frame 1 through a thin leaf spring 6.

Figure 3:
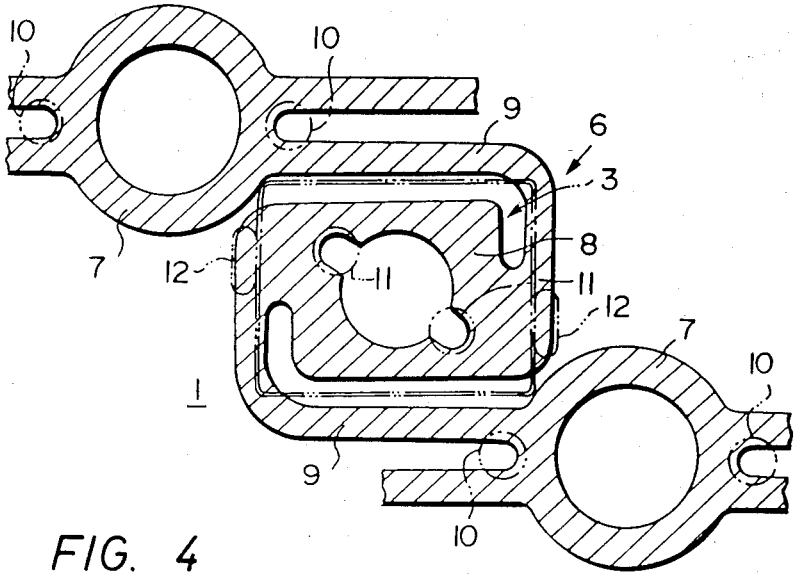
FIG. 3 is a partial plan view showing the detailed shape of a keytop return spring (thin leaf spring) in FIG. 2.
Figure 4:
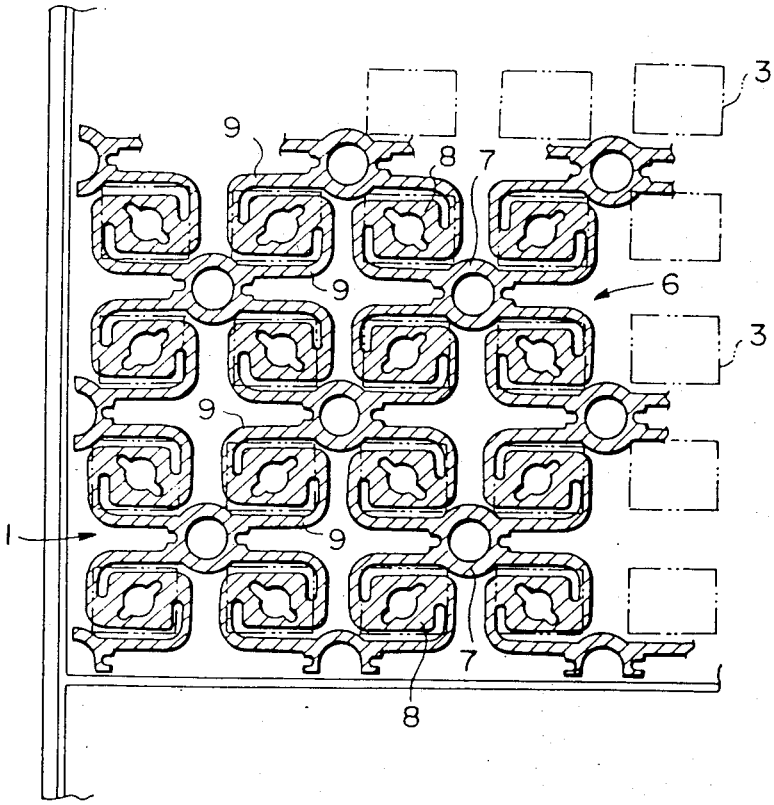
FIG. 4 is a partial back surface view of the keyboard showing the shape of the pattern of the keytop return spring (thin leaf spring) in FIG. 2.

The thin leaf spring 6 is a completely flat single sheet-like spring which is formed by punching a thin leaf spring material. As shown in FIGS. 3 and 4, a fixing portion 7 on the frame side, a fixing portion 8 on the keytop side and an arm-shaped spring portion 9 are formed. Each spring portion 9 is formed between these fixing portions 7 and 8 and serves to vertically apply a desired spring force to the surface between these fixing portions by properly selecting a thickness, a width and a length of the spring. Both of the fixing portions 7 and 8 are the rigid body portions where the substantial spring deformation does not occur as compared with the spring portion 9.

In the thin leaf spring 6 shown in FIGS. 3 and 4, the keytop side fixing portion 8 is formed at the arrangement position corresponding to each keytop 3. Every two arm-shaped spring portions 9 are connected to the fixing portion 8. In operation, each keytop 3 is elastically supported by means of the two spring portions 9.

In FIGS. 2 and 3, the thin leaf spring 6 is fixed to the frame 1 by means of a heat sealing 10 and is fixed to the keytops 3 by means of a heat sealing 11. On one hand, stopper portions 12 for positioning the keytops are formed to project from the periphery of the key hole 5 in the inside of the frame 1. By allowing the fixing portion 8 to be brought into contact with the stopper portions 12, a predetermined spring deformation is applied to the thin flat leaf spring 6 as shown by solid lines in FIG. 2, so that the keytop 3 is assembled in the state where the initial spring force (initial pressure) corresponding to the spring deformation was applied. In FIG. 2, an alternate long and two short dashes line indicates the position when the keytop 3 was depressed. If the pressing force is released, the keytop 3 is returned to the initial position indicated by the solid line due to the repulsive force of the thin leaf spring 6 and is held at the initial position by a predetermined initial spring force (initial pressure). Namely, the thin leaf spring 6 acts as a keytop return spring.

In FIG. 2, a boss 13 for depression of a movable contact is formed at the center of the back surface of the keytop 3.

The thin leaf spring (keytop return spring) 6 is formed by punching a sheet-like thin plate material so as to have a pattern shape as shown in FIG. 4.

According to the shape illustrated in FIG. 4, a plurality of spring portions 9, which are respectively connected to two or more keytops 3, are concentrically connected to the single fixing portion 7. Practically speaking, a plurality of (four) spring portions 9, which are respectively connected to the four keytops 3 around each frame side fixing portion 7, are concentrically connected to this fixing portion 7 excluding the regions of the four corners and sides of the keytop return spring 6. Simultaneously, the two spring portions 9 extending from the two frame side fixing portions 7 that locate at the diagonal positions of each keytop side fixing portion 8 are connected to this fixing portion 8. As will be obvious from FIG. 4 also, the keytop return spring 6 has the pattern shape consisting of constant repetitive patterns. The central portion of the fixing portion 7 forming a ring-shape can be pierced by a screw (not shown) to couple and fix the upper and lower casings 1 and 2.

FIG. 2 also shows the state in that the keyboard is attached to an electronic apparatus and is used. In FIG. 2, a lower circuit substrate 15, a spacer 16 and an upper circuit substrate 17 are assembled on the inner surface of the lower casing 2. Pressing the keytop 3 allows a contact (key pattern on the movable side) 18 of the upper circuit substrate 17 to be come into contact with a contact (key pattern on the fixed side) of the lower circuit substrate 15 by means of the boss 13.

According to the embodiment described in the above with reference to FIGS. 2 to 4, the following action and effect are derived.

(i) The frame 1 and the respective keytops 3 are mutually coupled by means of the single thin leaf spring (keytop return spring) 6, so that in the case where the keyboard is detached for maintenance, inspection or the like, it is possible to completely eliminate the state where the keytops 3 are removed and dispersed. Also, a work efficiency can be improved and a possibility of erroneous insertion of the keytops 3 upon reassembly can be eliminated.

(ii) The invention has the leaf spring shape in which a plurality of (in the example shown in the diagram, four) spring portions 9, that are respectively connected to two or more (in the example shown in the diagram, four) keytops 3, are concentrically connected to the single frame side fixing portion 7. Thus, the number of fixing portions of the keytop return spring 6 to the frame 1 and the number of those parts can be reduced and therefore the number of assembling processes can be reduced by the number commensurate with that reduction.

(iii) The keytop return spring 6 is formed by the completely flat and thin leaf spring, so that the processes for bending, reducing and the like can be eliminated. Therefore, it is possible to obtain the keytop return spring in which the number of working steps is small and the manufacturing cost is low and also ease of in handling is excellent.

(iv) The initial position of the keytop 3 is determined by making the keytop side fixing portion 8 come into contact with the frame 1, so that the prevention of pulling-out and the positioning of the keytops 3 can be performed by means of the keytop return spring 6 itself and the structure can be simplified. Also, there is no need to provide the flanges for prevention of pulling-out of the keytops as in the conventional structure to the keytops 3.

(v) Since the flange for prevention of the pulling-out of the keytop 3 does not exist, it is possible to adopt the working processes such that after the frame 1 and keytops 3 were integrally formed, they are cut out and the respective keytops 3 are assembled in the state where they are directly guided through the key holes 5. Therefore, there are also advantages such that the number of assembly steps is reduced and the keyboard can be cheaply manufactured.

(vi) By merely making the keytop return spring 6 come into contact with the frame 1, the initial deformation is applied and the initial spring force can be applied to the keytop 3. Therefore, unstable movement of the keytops 3 in operation can be eliminated by an extremely simple method.

(vii) The thin leaf spring of which the frame side fixing portions 7, keytop side fixing portions 8 and arm-shaped spring portions 9 were formed by means of a punching method is used as the keytop return spring 6. Thus, the spring deformation (stroke) can be made sufficiently large and the initial pressure and processing operation force of the keytop 3 can be easily and accurately set.

As will be clearly understood from the above description, according to the invention, the frame and the keytops are coupled by means of the thin leaf spring of which the frame side fixing portions, keytop side fixing portions and spring portions for connecting both of these fixing portions were formed. Therefore, the removal of the keytops from the frame upon detachment of the keyboard is eliminated and the handling in operation can be simplified.

In addition, the frame and the keytops are coupled by means of the above-mentioned thin leaf spring and the keytop side fixing portions come into contact with the stopper portions of the frame and thereby to apply the initial deformation. Consequently, the structure of the keyboard for use in an electronic apparatus in which a single flat and thin leaf spring can be used as the keytop return spring is provided.

Further, the frame side fixing portions, keytop side fixing portions and spring portions for connecting both of these fixing portions are formed by punching a sheet-like thin plate material. Also, a plurality of spring portions which are respectively connected to two or more keytops are concentrically connected to the single frame side fixing portion. Therefore, the keytop return spring which can reduce the number of processes when the keytops are fixed to the frame is obtained.

What is claimed is:

1. A keyboard for an electronic apparatus comprising:

a plurality of keytops for inputting information;

a frame having opening portions to expose said plurality of keytops from the inside of the electronic apparatus to the outside; and a spring member elastically supporting said plurality of keytops, wherein said spring member is fixed to said frame and includes a single flat and thin plate and said frame includes stopper portions projected near said opening portions for contacting said spring member to cause said spring member to be deformed.

2. A keyboard according to claim 1, wherein said spring member includes a plurality of elastic portions, one end of each said elastic portion being connected to a said keytop and the other ends of a plurality of said elastic portions being connected at a single coupling portion fixed to said frame.

3. A keyboard according to claim 2, wherein said spring member comprises a repetitive pattern formed by adjacently arranging a predetermined pattern of said keytops, said elastic portions and said coupling portion.

4. A keyboard for an electronic apparatus comprising:

a plurality of keytops for inputting information;

a frame having opening portions to expose said plurality of keytops from the inside of the electronic apparatus to the outside; and a spring member elastically supporting said plurality of keytops, wherein said spring member (i) is fixed to said frame, (ii) includes a plurality of elastic portions, one end of each said elastic portion being connected to a said keytop and the other ends of a plurality of said elastic portions being connected at a single ring-shaped coupling portion fixed to said frame, and (iii) is constructed such that two pairs of adjacent keytops are coupled to one single ring-shaped coupling portion fixed to said frame and such that each of said elastic portions coupling each keytop of the two pairs of adjacent keytops to the one single ring-shaped coupling portion are integrally coupled by the ring-shaped coupling portion.

5. A keyboard for an electronic apparatus comprising:

a plurality of keytops for inputting information;

a frame having opening portions to expose said plurality of keytops from the inside of the electronic apparatus to the outside and stopper portions projecting toward the inside of the electronic apparatus near said opening portions; and a spring member for elastically biasing said keytops toward said stopper portions, wherein said spring member includes a single flat and thin plate comprising a plurality of elastic members each connected at one end to one of said keytops and at the other end to a coupling member having a portion thereof fixed to said frame.

6. A keyboard according to claim 5, wherein said spring member comprises a repetitive pattern formed by adjacently arranging a predetermined pattern of said keytops, said elastic members and said coupling members.

7. A keyboard according to claim 5, wherein said spring member is constructed such that two pairs of adjacent keytops are coupled to said coupling member, and said coupling member is a ring-shaped member.

* * * * *